US011757178B2

(12) United States Patent
Wang et al.

(10) Patent No.: US 11,757,178 B2
(45) Date of Patent: Sep. 12, 2023

(54) ANTENNA OF A TERMINAL DEVICE

(71) Applicant: VIVO MOBILE COMMUNICATION CO., LTD., Guangdong (CN)

(72) Inventors: Yijin Wang, Dongguan (CN); Huan-chu Huang, Dongguan (CN); Xianjing Jian, Dongguan (CN)

(73) Assignee: VIVO MOBILE COMMUNICATION CO., LTD., Dongguan (CN)

( * ) Notice: Subject to any disclaimer, the term of this patent is extended or adjusted under 35 U.S.C. 154(b) by 356 days.

(21) Appl. No.: 17/200,164

(22) Filed: Mar. 12, 2021

(65) Prior Publication Data

US 2021/0218136 A1 Jul. 15, 2021

Related U.S. Application Data

(63) Continuation of application No. PCT/CN2019/101509, filed on Aug. 20, 2019.

(30) Foreign Application Priority Data

Sep. 14, 2018 (CN) ..... 201811076745.0

(51) Int. Cl.
*H01Q 1/24* (2006.01)
*H01Q 1/44* (2006.01)
(Continued)

(52) U.S. Cl.
CPC ..... *H01Q 1/44* (2013.01); *H01Q 1/36* (2013.01); *H01Q 1/48* (2013.01); *H01Q 1/50* (2013.01); *H01Q 21/0006* (2013.01)

(58) Field of Classification Search
CPC .... H01Q 13/10; H01Q 21/0006; H01Q 1/243; H01Q 1/38–52; H01Q 1/2266
See application file for complete search history.

(56) References Cited

U.S. PATENT DOCUMENTS 9,105,966 B1 * 8/2015 Dou ..... H01Q 13/106
2009/0256757 A1 10/2009 Chiang et al.
(Continued)

FOREIGN PATENT DOCUMENTS

CN 2231821 Y 7/1996
CN 103531911 A 1/2014
(Continued)

OTHER PUBLICATIONS

International Search Report and Written Opinion of the International Searching Authority regarding International Application No. PCT/CN2019/101509, dated Nov. 18, 2019. Translation provided by Bohui Intellectual Property.
(Continued)

*Primary Examiner* — Hasan Islam
(74) *Attorney, Agent, or Firm* — Harness, Dickey & Pierce, P.L.C.

(57) ABSTRACT

An antenna of a terminal device, the antenna includes a metal frame, a side of the metal frame is provided with at least two slot units, each slot unit includes a first slot ring and a second slot ring, the first slot ring and the second slot ring communicate through a third slot, an outer edge circumference of the first slot ring is different from that of the second slot ring. Portions of the metal frame on both sides of the third slot are provided with an antenna feed point and a ground feed point, respectively. The metal frame is electrically connected with a ground plate in the terminal device.

14 Claims, 4 Drawing Sheets

(51) Int. Cl.

| | |
|---|---|
| ***H01Q 1/36*** | (2006.01) |
| ***H01Q 1/48*** | (2006.01) |
| ***H01Q 1/50*** | (2006.01) |
| ***H01Q 21/00*** | (2006.01) |

(56) References Cited

U.S. PATENT DOCUMENTS

| | | | | |
|---|---|---|---|---|
| 2010/0271277 | A1 | 10/2010 | Kao et al. | |
| 2014/0132465 | A1 | 5/2014 | Sanchez et al. | |
| 2017/0194716 | A1 | 7/2017 | Kirino et al. | |
| 2018/0261921 | A1* | 9/2018 | Ha | H01Q 1/243 |

FOREIGN PATENT DOCUMENTS

| | | | |
|---|---|---|---|
| CN | 205621847 | U | 10/2016 |
| CN | 106329131 | A | 1/2017 |
| CN | 106654562 | A | 5/2017 |
| CN | 106935962 | A | 7/2017 |
| CN | 207217778 | U | 4/2018 |
| CN | 108232441 | A | 6/2018 |
| CN | 108270080 | A | 7/2018 |
| CN | 108288747 | A | 7/2018 |
| CN | 109193133 | A | 1/2019 |
| JP | 2002184889 | A | 6/2002 |
| JP | 2005136756 | A | 5/2005 |
| JP | 2014131231 | A | 7/2014 |

OTHER PUBLICATIONS

First Office Action regarding Chinese Patent Application No. 201811076745.0, dated Nov. 26, 2019. Translation provided by Bohui Intellectual Property.

Second Office Action regarding Chinese Patent Application No. 201811076745.0, dated Jun. 3, 2020. Translation provided by Bohui Intellectual Property.

"MM-Wave Phased Array Antenna for Whole-Metal-Covered 5G Mobile Phone Applications," J. Bang, et al., Dec. 21, 2017.

"A SAR Reduced MM-Wave Beam-Steerable Array Antenna with Dual-Mode Operation for Fully Metal-Covered 5G Cellular Handsets," J. Bang et al., dated May 14, 2018.

* cited by examiner

ANTENNA OF A TERMINAL DEVICE

CROSS REFERENCE TO RELATED APPLICATIONS

This application is a continuation of PCT Application No. PCT/CN2019/101509 filed on Aug. 20, 2019, which claims priority to Chinese Patent Application No. 201811076745.0, filed on Sep. 14, 2018, both of which are incorporated herein by reference in their entirety.

TECHNICAL FIELD

The present disclosure relates to the field of communications technologies, and in particular, to an antenna of a terminal device.

BACKGROUND

Multi-antenna communications has become the mainstream and a development trend of terminal devices in the future, and millimeter wave antennas are gradually introduced to terminal devices as the communications technologies evolve rapidly. In the related art, as the millimeter-wave antenna is generally in the form of an independent antenna module, it is required to provide space for accommodating the independent antenna module in a terminal device. In this case, the volume of the entire terminal device is relatively large, resulting in relatively low overall competitiveness of the terminal device.

SUMMARY

Some embodiments of the present disclosure provide an antenna of a terminal device, including a metal frame, where a side of the metal frame is provided with at least two slot units, each slot unit includes a first slot ring and a second slot ring, and the first slot ring and the second slot ring communicate through a third slot, and an outer edge circumference of the first slot ring is different from an outer edge circumference of the second slot ring; portions of the metal frame on both sides of the third slot are provided with an antenna feed point and a ground feed point, respectively; and the metal frame is electrically connected with a ground plate in the terminal device.

BRIEF DESCRIPTION OF DRAWINGS

To describe the technical solutions in some embodiments of the present disclosure more clearly, the following briefly describes the accompanying drawings required for describing some embodiments of the present disclosure. Apparently, the accompanying drawings in the following description show merely some embodiments of the present disclosure, and a person of ordinary skill in the art may still derive other drawings from these accompanying drawings.

DETAILED DESCRIPTION OF EMBODIMENTS

The following clearly describes the technical solutions in some embodiments of the present disclosure with reference to the accompanying drawings in some embodiments of the present disclosure. Apparently, the described embodiments are merely some but not all of the embodiments of the present disclosure. All other embodiments obtained by a person of ordinary skill in the art based on the embodiments of this disclosure shall fall within the protection scope of this disclosure.

Figure 1:
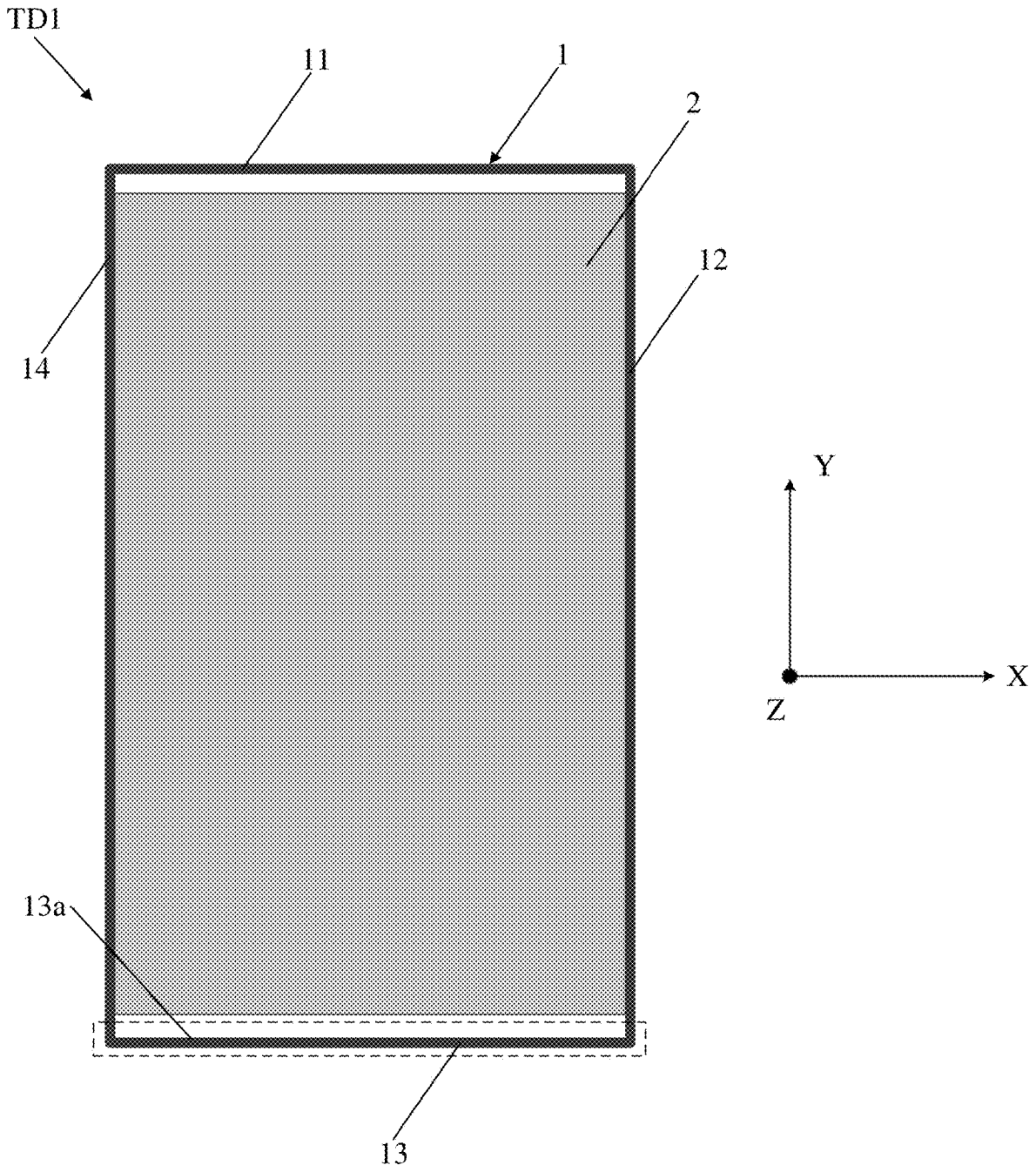
FIG. 1 is a schematic structural diagram of an antenna of a terminal device according to some embodiments of the present disclosure.

Refer to FIG. 1, which is a schematic structural diagram of an antenna of a terminal device according to some embodiments of the present disclosure. As shown in FIG. 1, the antenna of the terminal device includes a metal frame 1, a side of the metal frame 1 is provided with at least two slot units, each slot unit includes a first slot ring and a second slot ring, the first slot ring and the second slot ring communicate through a third slot, and an outer edge circumference of the first slot ring is different from an outer edge circumference of the second slot ring; portions of the metal frame on both sides of the third slot are provided with an antenna feed point and a ground feed point, respectively; and the metal frame 1 is electrically connected with a ground plate 2 in the terminal device TD1.

In some embodiments, the foregoing metal frame 1 may include a first side 11, a second side 12, a third side 13 and a fourth side 14, and the metal frame 1 may be a frame of which ends are connected or disconnected. The insides of the foregoing slot ring and slot may be air or filled with a non-conductive material. The foregoing ground plate 2 may be a circuit board or a metal middle frame, or the like. The foregoing metal frame 1 is electrically connected with the ground plate 2 within the terminal device TD1, so that the metal frame 1 can be grounded.

Figure 2:
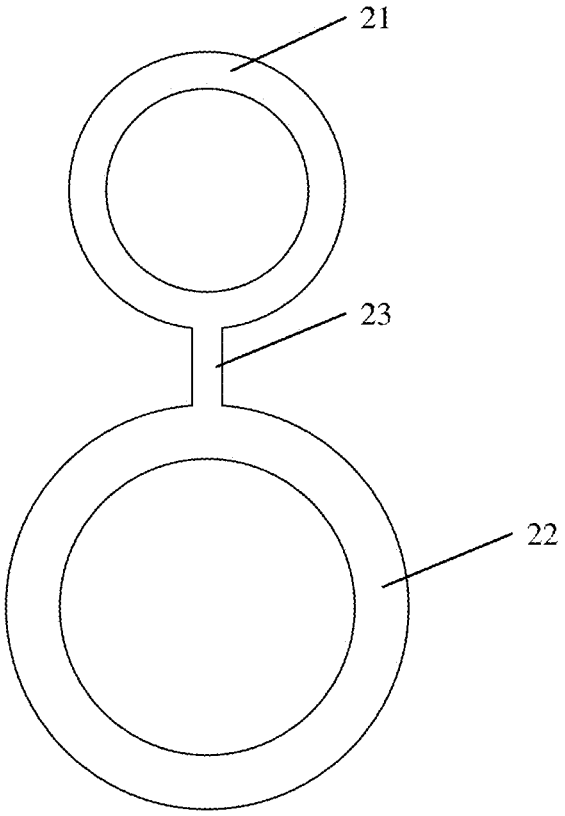
FIG. 2 is a schematic structural diagram of a slot unit according to some embodiments of the present disclosure.

In some embodiments, reference may be made to FIG. 2 to better understand the foregoing slot unit, which is a schematic structural diagram of a slot unit according to some embodiments of the present disclosure. As shown in FIG. 2, the slot unit includes a first slot ring 21 and a second slot ring 22, and the first slot ring 21 and the second slot ring 22 communicate through a third slot 23. The outer edge circumference of the first slot ring 21 is different from the outer edge circumference of the second slot ring 22, and the outer edge circumference of the first slot ring 21 may be less than or greater than that of the second slot ring 22. Portions of the metal frame on both sides of the third slot 23 are provided with an antenna feed point and a ground feed point, which may be that the metal frame on the left side of the third slot 23 is provided with the antenna feed point and the metal frame on the right side is provided with a ground feed point;

or the metal frame on the right side of the third slot 23 is provided with an antenna feed point and the metal frame on the left side is provided with a ground feed point.

It is sure that in addition to the configuration mode in FIG. 2, it is also possible that the first slot ring 21 is disposed at the bottom, and the second slot ring 22 is disposed at the top, or the like, which is not limited in the present disclosure.

In some embodiments, at least two slot units are arranged at a side of the metal frame 1, and the at least two slot units are equivalent to forming a millimeter wave array antenna for a radiating millimeter wave signal. When at least two slot units are arranged on the third side 13, a communications antenna may be in an area as shown by a dashed line in FIG. 1, and the communications antenna is composed of the third side 13, a part of the second side 12 and a part of the fourth side 14. In addition, the millimeter wave array antenna composed of the at least two slot units is a tiny slot inside a radiating body of the communications antenna, so that electrical parameters of a non-millimeter wave communications antenna are not affected. It is sure that in addition to arranging at least two slot units on the third side 13, the first side 11, the second side 12 or the fourth side 14 may also be provided with at least two slot units, which is not limited in the present disclosure.

In this way, arranging at least two slot units at a side of the metal frame 1 of the terminal device is equivalent to forming a millimeter wave array antenna, thereby saving space for accommodating a millimeter wave array antenna, skipping occupying antenna space for another antenna, reducing a volume of the terminal device and improving overall competitiveness of the terminal device. A structure of the terminal device can be fully used as a millimeter wave array antenna to enhance a communications effect without affecting metal texture of the terminal device. In addition, it can be avoided that performance of the millimeter wave antenna dropping significantly when the back facet of the terminal device is blocked by a metal table or when a user holds the terminal device in hand, thus providing a better user experience.

In addition, integrating a millimeter wave array antenna into a communications antenna in the related art, such as second generation (2G), third generation (3G), fourth generation (4G), or sub sixth generation (6G), does not affect communications quality of the communications antenna or a function of the terminal device. At the same time, the millimeter wave array antenna can obtain a better broadband width. As each slot unit includes a first slot ring and a second slot ring, it can cover multiple fifth generation (5G) millimeter wave frequency bands, which facilitates an antenna design in the full-screen era. The metal frame design based on the terminal device of the present disclosure does not affect metal texture of the terminal device, and can improve wireless experience of a user in the case of transnational roaming.

It is often difficult to make a current mainstream millimeter wave antenna design, such as an antenna-in-package (AiP) millimeter wave antenna module, to exhibit good antenna performance under a design with a metal appearance, that is, it is difficult to support the design with a metal appearance, thus reducing competitiveness of a manufactured product. Such a design pattern of this embodiment can support the design with a metal appearance in a better way, and can be compatible with the design with a metal appearance as a solution for another antenna, to enhance overall competitiveness of a product. It can resolve the problem that it is required to arrange space for accommodating a millimeter wave antenna in a terminal device, which requires a large volume of the entire terminal device, it can also resolve the problem that it is difficult for a terminal device to support a design with a metal appearance.

In some embodiments of the present disclosure, the foregoing terminal device may be a mobile phone, a tablet personal computer (Tablet Personal Computer), a laptop computer (Laptop Computer), a personal digital assistant (personal digital assistant, PDA), a mobile Internet device (Mobile Internet Device, MID), a wearable device (Wearable Device), or the like.

Alternatively, an inner edge circumference of the first slot ring is different from an inner edge circumference of the second slot ring.

In some embodiments, the inner edge circumference of the foregoing first slot ring is different from the inner edge circumference of the second slot ring, which may be that the inner edge circumference of the first slot ring is greater than or less than that of the second slot ring.

If the outer edge circumferences of the first slot ring and the second slot ring are combined, there may be many situations as follows. The inner edge circumference of the first slot ring is greater than that of the second slot ring, and the outer edge circumference of the first slot ring is greater than that of the second slot ring; or the inner edge circumference of the first slot ring is greater than that of the second slot ring, and the outer edge circumference of the first slot ring is less than that of the second slot ring; or the inner edge circumference of the first slot ring is less than that of the second slot ring; and the outer edge circumference of the first slot ring is less than that of the second slot ring; or the inner edge circumference of the first slot ring is less than that of the second slot ring, and the outer edge circumference of the first slot ring is greater than that of the second slot ring. It is sure that a specific configuration mode may be determined according to an actual situation, which is not limited in the present disclosure.

Alternatively, any antenna feed point and ground feed point are located on an inner side wall of the metal frame (for example, an inner side wall 13*a* of the third side 13 in FIG. 1).

In some embodiments, any antenna feed point and ground feed point are located on an inner side wall of the metal frame, which firstly, can facilitate easy configuration of the antenna feed point and ground feed point, and secondly, will not affect an appearance of the terminal device.

Alternatively, at least two slot units are arranged along a length direction of the metal frame 1.

In some embodiments, the foregoing at least two slot units are arranged along the length direction of the metal frame 1, which can firstly, facilitate configuration of multiple slot units on the metal frame 1, and secondly, facilitate forming a millimeter wave array antenna by the at least two slot units to radiate or receive a millimeter wave signal.

Figure 3:
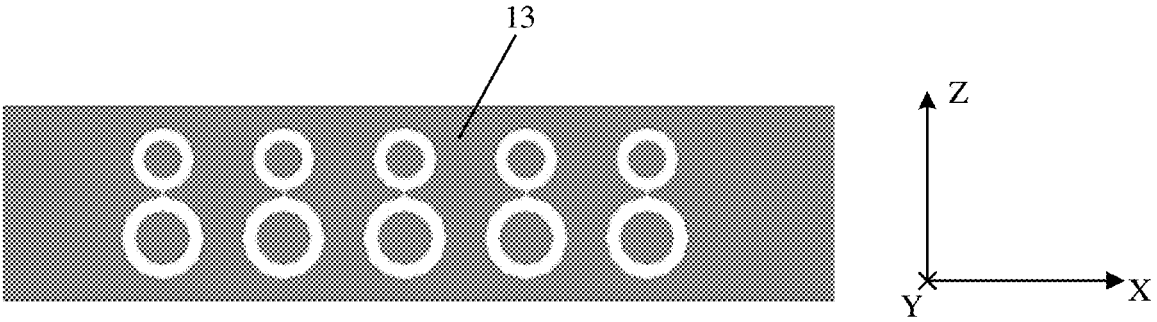
FIG. 3 is a first schematic structural diagram of a side of a metal frame according to some embodiments of the present disclosure.

Reference may be made to FIG. 3 to better understand the foregoing configuration mode, which is a schematic structural diagram of a side of a metal frame according to the present disclosure. As shown in FIG. 3, there are at least five slot units on the third side 13 of the metal frame 1, and the at least five slot units are arranged along a length direction of the third side 13 of the metal frame 1 to form a millimeter wave array antenna.

Each slot unit is composed of a slot of a big ring and a slot of a small ring. A slot connecting the big circle and the small ring may be a short slot in the Z direction. The Z direction is a direction perpendicular to the screen. The slot of the big ring works with the metal frame around it at a low frequency of the millimeter wave frequency band, and the slot of the small ring works with the metal frame around it at a high frequency of the millimeter wave frequency band. No restriction is made on the width of the slot unit. In the case that the inside of the slot unit is air, an outer circumference and an inner circumference of the big ring may be unlimited; and an outer circumference and an inner circumference of the small ring may also be unlimited.

It should be noted that the first slot ring may be a slot of a big ring, and the second slot ring may be a slot of a small ring; or the first slot ring may be a slot of a small ring, and the second slot ring may be a slot of a big ring. No restriction is made on that in this embodiment.

It is sure that as an alternative solution, the outer circumference of the big ring may be 13.6 mm, the inner circumference of the big ring may be 8.2 mm; the outer circumference of the small ring may be 9.5 mm; and the inner circumference of the small ring may be 5.6 mm. In the case that the slot is filled with a non-conductive medium, these parameters may be adjusted according to an actual bandwidth, and may also cover multiple bands of a millimeter wave.

Alternatively, spacing between two adjacent slot units is determined by isolation between the two adjacent slot units and performance of a beam scanning coverage angle of an array antenna.

In some embodiments, spacing between the foregoing two adjacent slot units is determined by isolation between the two adjacent slot units and performance of a beam scanning coverage angle of the array antenna, with which the millimeter wave signal can work in a better way.

Alternatively, spacing between any two adjacent slot units is a same.

In some embodiments, spacing between any two adjacent slot units is the same, which can make an appearance more symmetrical, and ensure that a millimeter wave array antenna composed of at least two slot units has better performance, with which the millimeter wave signal can work in a better way.

Alternatively, both the first slot ring and the second slot ring are circular slots, a width of the third slot is less than an inner radius of the first slot ring and less than an inner radius of the second slot ring.

Figure 4:
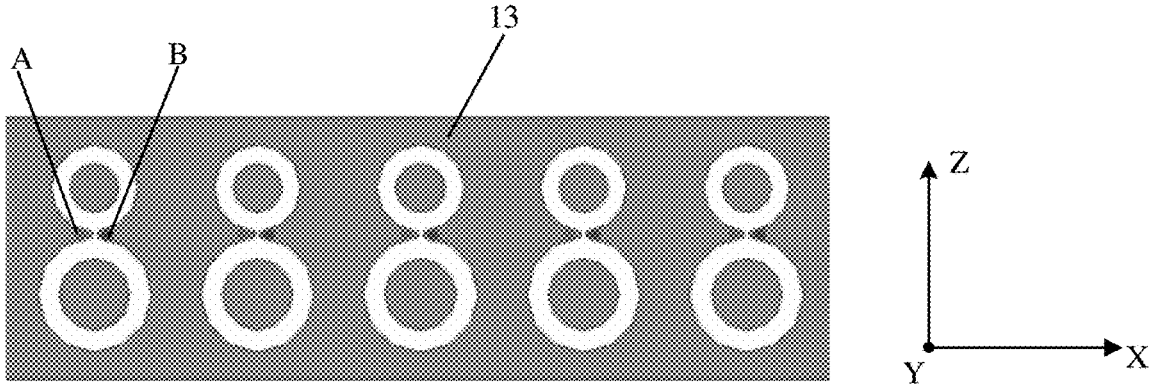
FIG. 4 is a second schematic structural diagram of a side of a metal frame according to some embodiments of the present disclosure.

In some embodiments, reference may be made to FIG. 4 to better understand the foregoing configuration mode, which is a schematic structural diagram of a side of a metal frame according to the present disclosure. As shown in FIG. 4, there are at least five slot units on the third side 13 of the metal frame 1. Take the leftmost slot unit as an example. A first slot ring of the slot unit may be a slot of the upper small ring, and a second slot ring of the slot unit may be a slot of the lower big ring. The first slot ring and the second slot ring communicate through a third slot. As an alternative solution, the third slot may be located on a straight line determined by a center of the small ring and a center of the big ring. A width of the third slot is less than an inner radius of the first slot ring and less than an inner radius of the second slot ring. The width of the third slot may also be unlimited.

A feed point A and a feed point B are disposed on both sides of the third slot respectively. The feed point A may be an antenna feed point, and the feed point B may be a ground feed point; or the feed point A may be a ground feed point, and the feed point B may be an antenna feed point. It is sure that the feed point A and the feed point B may be distinguished by setting different colors for them, for example, the feed point A is green, the feed point B is red, or the like.

Figure 5:
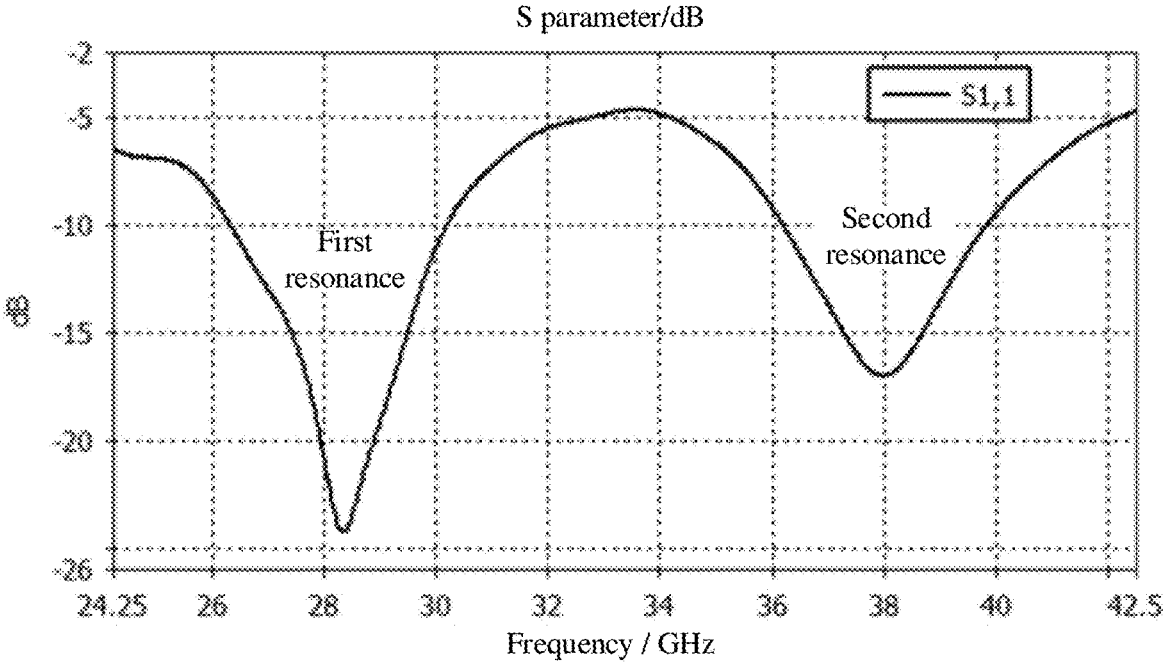
FIG. 5 is a schematic diagram of a return loss of a single slot unit according to some embodiments of the present disclosure.

Refer to FIG. 5 again, which is a schematic diagram of a return loss of a single slot unit according to some embodiments of the present disclosure. Each slot unit can cover bandwidths of 26.5-29.5 GHz and 37-40 GHz, that is, multiple 5G millimeter wave bands (n257, n261, n260, and the like). As shown in FIG. 4 and FIG. 5, introduction of a feed signal can stimulate the slot of the big ring to generate a first resonance, and stimulate the slot of the small ring to generate a second resonance, so that the millimeter wave array antenna can cover multiple frequency bands.

In some embodiments, integrating the millimeter wave array antenna into a communications antenna in the related art, such as 2G, 3G, 4G or sub 6G, does not affect communications quality of the communications antenna or a function of the terminal device. At the same time, the millimeter wave array antenna can obtain a better broadband width. As each slot unit includes a first slot ring and a second slot ring, it can cover multiple 5G millimeter wave frequency bands, which facilitates an antenna design in the full-screen era. The metal frame design based on the terminal device of the present disclosure does not affect metal texture of the terminal device, and can improve wireless experience of a user in the case of transnational roaming or even global roaming.

The millimeter wave array antenna of this embodiment is highly symmetrical. When the millimeter wave array antenna performs beam scanning, performance of beams in the positive and negative directions is similar, and a better scanning range can be achieved.

Alternatively, distances between at least two consecutive points on an upper edge of each slot unit and an upper edge of the metal frame are a first constant value; and/or distances between at least two consecutive points on a lower edge of each slot unit and a lower edge of the metal frame are a second constant value.

Figure 6:
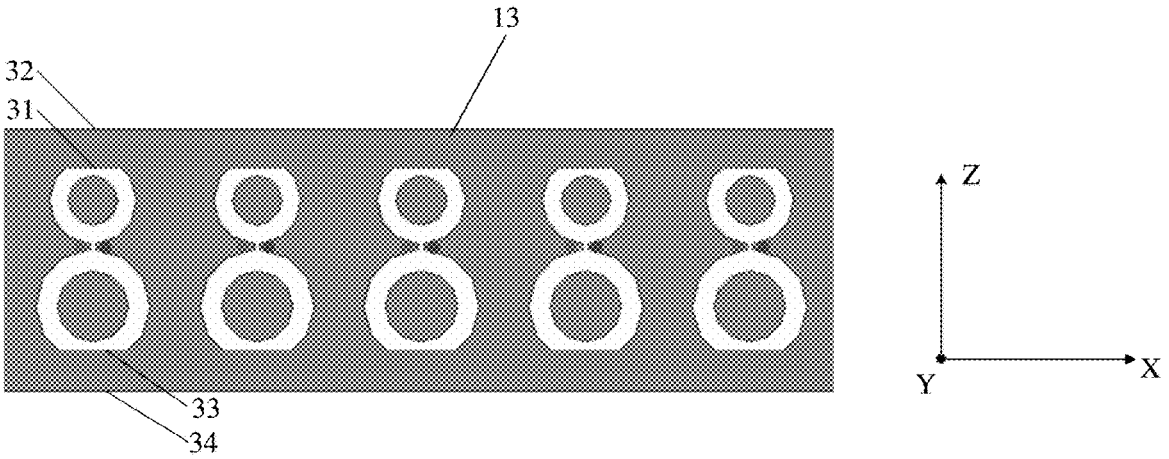
FIG. 6 is a third schematic structural diagram of a side of a metal frame according to some embodiments of the present disclosure.

In some embodiment, the first constant value and the second constant value may be a same value or different values, which is not limited in the present disclosure. Reference may be made to FIG. 6 to better understand the foregoing configuration mode, which is a schematic structural diagram of a side of a metal frame according to the present disclosure. As shown in FIG. 6, there are at least five slot units on the third side 13 of the metal frame 1, distances between at least two consecutive points on an upper edge 31 of each slot unit and an upper edge 32 of the metal frame are a first constant value, and distances between at least two consecutive points on a lower edge 33 of each slot unit and a lower edge 34 of the metal frame are a second constant value.

The foregoing configuration mode may be understood as setting the upper and lower edges of the "8" shaped slot as a straight line segment. It is sure that the slot may also be filled with a non-conductive medium to form a millimeter wave array antenna. In this way, space occupied by the millimeter wave array antenna is reduced, and space occupied in the Z direction is reduced, and thus a thickness of the entire terminal device can be reduced.

Alternatively, each slot unit of the at least two slot units and a third slot corresponding to the slot unit are filled with a non-conductive material.

In some embodiments, each slot unit of the at least two slot units and a third slot corresponding to the slot unit are filled with a non-conductive material. In this way, the appearance is more aesthetic, the metal frame 1 has a stronger overall structural strength, and the slot unit won't be exposed directly outside.

Alternatively, both the first slot ring and the second slot ring are rectangular ring-shaped slots, a position communicating the third slot with the first slot ring is located at a midpoint of the outer side of the first slot ring, and a position communicating the third slot with the second slot ring is located at a midpoint of the outer side of the second slot ring.

Figure 7:
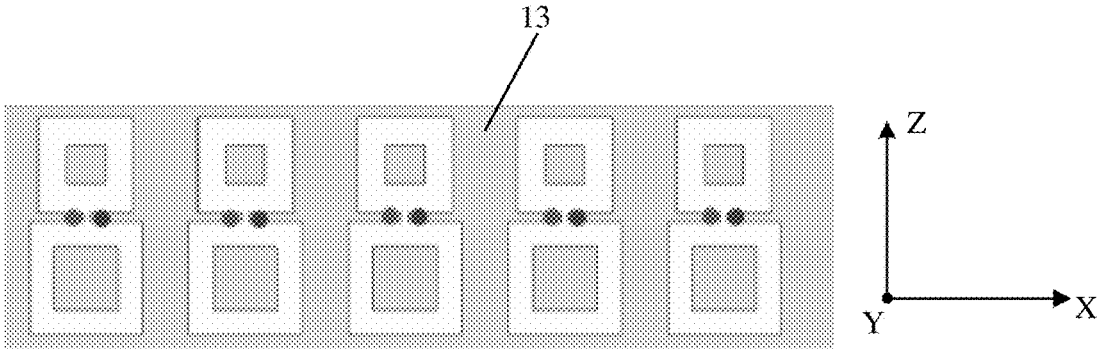
FIG. 7 is a fourth schematic structural diagram of a side of a metal frame according to some embodiments of the present disclosure.

In some embodiments, reference may be made to FIG. 7 to better understand the foregoing configuration mode, which is a schematic structural diagram of a side of a metal frame according to the present disclosure. As shown in FIG. 7, there are at least five slot units on the third side 13 of the metal frame 1, a slot above each slot unit is a small square ring-shaped slot, and a slot below each slot unit is a large square ring-shaped slot. And a position connecting the third slot with the small square ring-shaped slot is located at a midpoint of the outer side of the small square ring-shaped slot, and a position connecting the third slot with the large square ring-shaped slot is located at a midpoint of the outer side of the large square ring-shaped slot. Some embodiment can reduce space occupied in the Z direction.

Alternatively, a length direction of the first slot ring and/or a length direction of the second slot ring are consistent with a length direction of the metal frame.

Figure 8:
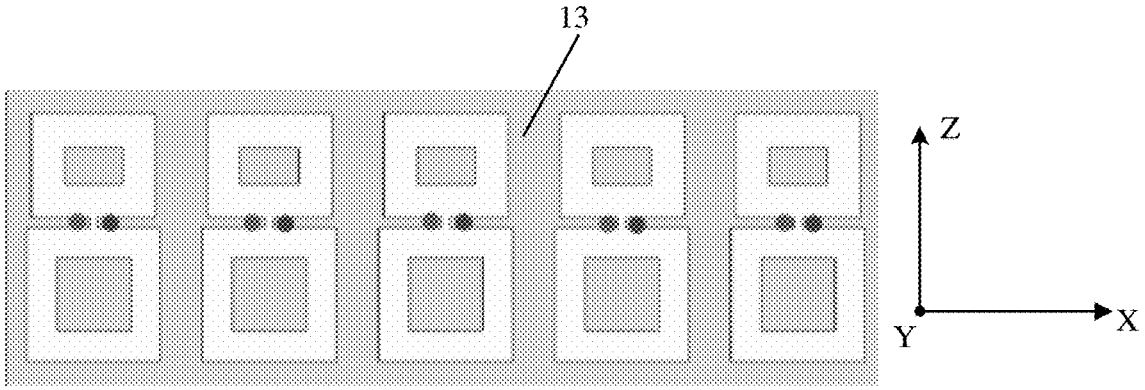
FIG. 8 is a fifth schematic structural diagram of a side of a metal frame according to some embodiments of the present disclosure.

In some embodiments, reference may be made to FIG. 8 to better understand the foregoing configuration mode, which is a schematic structural diagram of a side of a metal frame according to the present disclosure. As shown in FIG. 8, there are at least five slot units on the third side 13 of the metal frame 1, and the slot above each slot unit is a rectangular ring-shaped slot, and the slot below each slot unit is a square ring-shaped slot. A length direction of the rectangular ring-shaped slot is consistent with a length direction of the metal frame 1, so that the space occupied in the Z direction can be further reduced.

Alternatively, both the first slot ring and the second slot ring are rhombus ring-shaped slots, a position communicating the third slot with the first slot ring is located at a corner of a rhombus formed by the first slot ring, and a position communicating the third slot with the second slot ring is located at a corner of a rhombus formed by the second slot ring.

Figure 9:
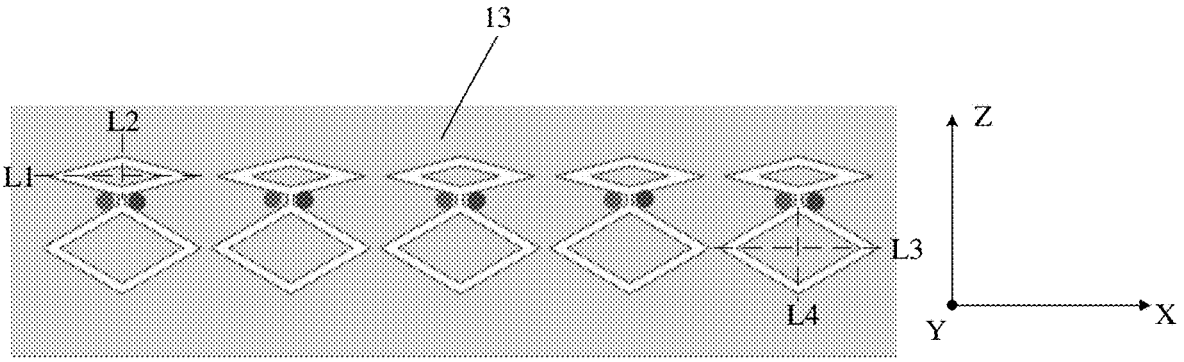
FIG. 9 is a sixth schematic structural diagram of a side of a metal frame according to some embodiments of the present disclosure.

In some embodiments, reference may be made to FIG. 9 to better understand the foregoing configuration mode, which is a schematic structural diagram of a side of a metal frame according to the present disclosure. As shown in FIG. 9, there are at least five slot units on the third side 13 of the metal frame 1, both the slot above each slot unit and the slot below each slot unit are rhombus ring-shaped slots, and the rhombus ring shape of the slot above occupies very small space in the Z direction, so that the space occupied in the Z direction can be further reduced. It is sure that the rhombus ring shape of the slot below can also be set to occupy very small space in the Z direction according to a need, which is not limited in the present disclosure.

Alternatively, in two diagonal lines of the rhombus formed by the first slot ring, a length of a diagonal line (for example, diagonal L1 in FIG. 9) parallel to a length direction of the metal frame is longer than a length of a diagonal line (for example, diagonal L2 in FIG. 9) parallel to a width direction of the metal frame; and/or, in two diagonal lines of the rhombus formed by the second slot ring, a length of a diagonal line (for example, diagonal L3 in FIG. 9) parallel to a length direction of the metal frame is longer than a length of a diagonal line (for example, diagonal L4 in FIG. 9) parallel to a width direction of the metal frame.

In some embodiments, in two diagonal lines of the rhombus formed by the first slot ring, a length of a diagonal line parallel to a length direction of the metal frame is longer than a length of a diagonal line parallel to a width direction of the metal frame; and/or, in two diagonal lines of the rhombus formed by the second slot ring, a length of a diagonal line parallel to a length direction of the metal frame is longer than a length of a diagonal line parallel to a width direction of the metal frame. In this way, the space occupied by the slot unit in the Z direction can be further reduced.

Alternatively, the rhombus formed by the first slot ring is similar or dissimilar to the rhombus formed by the second slot ring.

In some embodiments, the rhombus formed by the first slot ring is similar or dissimilar to the rhombus formed by the second slot ring, which may be set according to an actual need, so as to improve flexibility of the terminal device.

The antenna of the terminal device according to some embodiments of the present disclosure, including a metal frame 1, where a side of the metal frame 1 is provided with at least two slot units, each slot unit includes a first slot ring and a second slot ring, and the first slot ring and the second slot ring communicate through a third slot, and an outer edge circumference of the first slot ring is different from an outer edge circumference of the second slot ring; portions of the metal frame on both sides of the third slot is provided with an antenna feed point and a ground feed point; and the metal frame 1 is electrically connected with a ground plate 2 in the terminal device. In this way, the metal frame 1 provided with the at least two slot units is equivalent to a millimeter wave array antenna of the terminal device, and the metal frame 1 is also a radiating body of a non-millimeter wave communications antenna, thus saving space for accommodating a millimeter wave antenna, reducing a volume of the terminal device, and supporting a design of a metal appearance in a better way. In addition, it is compatible with a design of a metal appearance as a solution for another antenna, to improve overall competitiveness of the terminal device. At the same time, the millimeter wave array antenna can obtain a better broadband width. As each slot unit includes a first slot ring and a second slot ring, it can cover multiple 5G millimeter wave frequency bands, which facilitates an antenna design in the full-screen era. The metal frame design based on the terminal device of the present disclosure does not affect metal texture of the terminal device, and can improve wireless experience of a user in case of transnational roaming or even global roaming.

It should be noted that the terms "include", "comprise" or any other variants thereof herein are intended to cover a non-exclusive inclusion, so that a process, a method, an article or equipment that includes a list of elements not only includes those elements, and further includes another element not expressly listed, or an element inherent to such a process, a method, an article, or equipment. In the absence of more limitations, an element defined by "including a . . . " does not preclude the existence of other identical elements in the process, method, article, or apparatus that includes the element.

The embodiments of the present disclosure are described above with reference to the accompanying drawings, but the present disclosure is not limited to the foregoing specific implementations. The foregoing specific implementations are merely schematic instead of restrictive. Under enlightenment of the present disclosure, a person of ordinary skills in the art may make many forms without departing from the aims of the present disclosure and the protection scope of claims, all of which fall within the protection of the present disclosure.

What is claimed is:

1. An antenna of a terminal device, the antenna comprising:

a metal frame, wherein a side of the metal frame is provided with at least two slot units, each slot unit comprises a first slot ring and a second slot ring, the first slot ring and the second slot ring communicate through a third slot, and an outer edge circumference of the first slot ring is different from an outer edge circumference of the second slot ring;

portions of the metal frame on both sides of the third slot are provided with an antenna feed point and a ground feed point, respectively; and the metal frame is electrically connected with a ground plate in the terminal device.

2. The antenna of the terminal device according to claim 1, wherein an inner edge circumference of the first slot ring is different from an inner edge circumference of the second slot ring.

3. The antenna of the terminal device according to claim 1, wherein any antenna feed point and ground feed point are located on an inner side wall of the metal frame.

4. The antenna of the terminal device according to claim 1, wherein the at least two slot units are arranged along a length direction of the metal frame.

5. The antenna of the terminal device according to claim 1, wherein spacing between two adjacent slot units is determined by isolation between the two adjacent slot units and performance of a beam scanning coverage angle of an array antenna.

6. The antenna of the terminal device according to claim 1, wherein spacing between any two adjacent slot units is a same.

7. The antenna of the terminal device according to claim 1, wherein both the first slot ring and the second slot ring are circular slots, a width of the third slot is less than an inner radius of the first slot ring, and less than an inner radius of the second slot ring.

8. The antenna of the terminal device according to claim 7, wherein distances between at least two consecutive points on an upper edge of each slot unit and an upper edge of the metal frame are a first constant value; and/or distances between at least two consecutive points on a lower edge of each slot unit and a lower edge of the metal frame are a second constant value.

9. The antenna of the terminal device according to claim 1, wherein each slot unit of the at least two slot units and a third slot corresponding to the slot unit are filled with a non-conductive material.

10. The antenna of the terminal device according to claim 1, wherein both the first slot ring and the second slot ring are rectangular ring-shaped slots, a position communicating the third slot with the first slot ring is located at a midpoint of the outer side of the first slot ring, and a position communicating the third slot with the second slot ring is located at a midpoint of the outer side of the second slot ring.

11. The antenna of the terminal device according to claim 10, wherein a length direction of the first slot ring and/or a length direction of the second slot ring are consistent with a length direction of the metal frame.

12. The antenna of the terminal device according to claim 1, wherein both the first slot ring and the second slot ring are rhombus ring-shaped slots, a position communicating the third slot with the first slot ring is located at a corner of a rhombus formed by the first slot ring, and a position communicating the third slot with the second slot ring is located at a corner of a rhombus formed by the second slot ring.

13. The antenna of the terminal device according to claim 12, wherein in two diagonal lines of the rhombus formed by the first slot ring, a length of a diagonal line parallel to a length direction of the metal frame is longer than a length of a diagonal line parallel to a width direction of the metal frame; and/or, in two diagonal lines of the rhombus formed by the second slot ring, a length of a diagonal line parallel to a length direction of the metal frame is longer than a length of a diagonal line parallel to a width direction of the metal frame.

14. The antenna of the terminal device according to claim 12, wherein the rhombus formed by the first slot ring is similar or dissimilar to the rhombus formed by the second slot ring.

* * * * *